US012078051B2

(12) United States Patent
Frankland et al.

(10) Patent No.: US 12,078,051 B2
(45) Date of Patent: Sep. 3, 2024

(54) FLOW MEASURING AND MONITORING APPARATUS FOR A SUBSEA TREE

(71) Applicant: ONESUBSEA IP UK LIMITED, London (GB)

(72) Inventors: Jonathan Mark Frankland, Leeds (GB); Wayne Hand, Houston, TX (US)

(73) Assignee: ONESUBSEA IP UK LIMITED, London (GB)

( * ) Notice: Subject to any disclaimer, the term of this patent is extended or adjusted under 35 U.S.C. 154(b) by 0 days.

(21) Appl. No.: 18/471,406

(22) Filed: Sep. 21, 2023

(65) Prior Publication Data

US 2024/0011388 A1 Jan. 11, 2024

Related U.S. Application Data

(62) Division of application No. 17/596,686, filed as application No. PCT/US2020/040460 on Jul. 1, 2020, now Pat. No. 11,795,807.

(Continued)

(51) Int. Cl.

| | |
|---|---|
| ***E21B 47/001*** | (2012.01) |
| ***E21B 33/035*** | (2006.01) |
| ***E21B 34/04*** | (2006.01) |

(52) U.S. Cl.

CPC ..... *E21B 47/001* (2020.05); *E21B 33/035* (2013.01); *E21B 34/04* (2013.01)

(58) Field of Classification Search

CPC ..... E21B 47/001; E21B 33/035; E21B 34/04; E21B 33/076

See application file for complete search history.

(56) References Cited

U.S. PATENT DOCUMENTS

2006/0108120 A1 5/2006 Saucier
2010/0101799 A1 4/2010 Spencer et al.

(Continued)

FOREIGN PATENT DOCUMENTS

WO 2017209728 A1 12/2017

OTHER PUBLICATIONS

International Search Report and Written Opinion issued in PCT Application PCT/US2020/040460 dated Oct. 13, 2020 (12 pages).

(Continued)

*Primary Examiner* — James G Sayre
(74) *Attorney, Agent, or Firm* — Jeffrey D. Frantz

(57) ABSTRACT

A subsea tree assembly with a flow monitoring and measuring apparatus includes a production wing valve block coupled to a production wing branch, the production wing valve block including a wing block connector, and a fluid processing module including a frame, a module connector including an inlet and an outlet, and a fluid flow loop coupled between the inlet and the outlet, wherein the module connector is fluidicly coupled to the wing block connector. A production fluid flow goes from the production wing valve block and returns to the same block via the wing block connector, the module connector, and the fluid flow loop. A flow monitoring and measuring apparatus for a subsea tree assembly includes a module frame, a module connector connectable to a production wing valve block, the module connector including an inlet and an outlet, and a fluid flow conduit forming a loop from the outlet of the module connector back to the inlet of the module connector.

8 Claims, 4 Drawing Sheets

Related U.S. Application Data

(60) Provisional application No. 62/869,347, filed on Jul. 1, 2019.

(56) References Cited

U.S. PATENT DOCUMENTS

| | | | | |
|---|---|---|---|---|
| 2012/0048567 | A1 | 3/2012 | June | |
| 2012/0273214 | A1 | 11/2012 | Donald et al. | |
| 2013/0206420 | A1 | 8/2013 | McHugh et al. | |
| 2014/0262306 | A1 | 9/2014 | Hosie | |
| 2015/0027730 | A1* | 1/2015 | Hall | E21B 33/03 166/97.1 |
| 2015/0292291 | A1 | 10/2015 | Donald et al. | |
| 2016/0017680 | A1 | 1/2016 | June | |
| 2016/0341029 | A1 | 11/2016 | Phillips et al. | |
| 2017/0254169 | A1 | 9/2017 | Murphy | |
| 2018/0223619 | A1 | 8/2018 | June | |
| 2018/0298748 | A1* | 10/2018 | Rustad | E21B 47/10 |
| 2019/0284901 | A1* | 9/2019 | Murphy | E21B 33/035 |
| 2020/0123867 | A1 | 4/2020 | Riley et al. | |
| 2020/0248522 | A1 | 8/2020 | Rivlin | |

OTHER PUBLICATIONS

International Preliminary Report on Patentability issued in PCT Application PCT/US2020/040460 dated Jan. 13, 2022, 8 pages.
Exam Report under Section 18(3) issued in United Kingdom Patent Application No. GB2118407.2 dated Oct. 7, 2022, 4 pages.

* cited by examiner

FLOW MEASURING AND MONITORING APPARATUS FOR A SUBSEA TREE

CROSS-REFERENCE TO RELATED APPLICATIONS

This patent application is a divisional of U.S. patent application Ser. No. 17/596,686, filed Dec. 16, 2021, which is a National Stage Entry of PCT/US2020/040460, filed Jul. 1, 2020, which claims the benefit of and priority to U.S. Provisional Application No. 62/869,347, filed Jul. 1, 2019. Each of the above applications is incorporated herein by reference in its entirety.

STATEMENT REGARDING FEDERALLY SPONSORED RESEARCH OR DEVELOPMENT

Not applicable.

BACKGROUND

Hydrocarbon fluids such as oil and natural gas are obtained from a subterranean geologic formation, referred to as a reservoir, by drilling a well that penetrates the hydrocarbon-bearing formation. Once a wellbore is drilled, various forms of well completion components may be installed in order to control and enhance the efficiency of producing the various fluids from the reservoir. In some cases, the wellbore is drilled starting at the sea floor. In such cases, additional subsea equipment may be necessary. One piece of equipment which may be installed is a subsea Christmas tree or valve tree.

Christmas trees or valve trees are well known in the art of oil and gas wells, and generally comprise an assembly of pipes, valves, and fittings installed in a wellhead after completion of drilling and installation of the production tubing to control the flow of oil and gas from the well. Subsea Christmas trees typically have at least two bores, one of which communicates with the production tubing (the production bore), and the other of which communicates with the annulus (the annulus bore). Subsea trees also include a valve block atop the axial production bore, and a production wing or lateral branch extending laterally from the valve block to provide a side outlet for removal of production fluids from the production bore. The production bore can be closed by a production wing valve disposed in the production wing branch. The physical orientation of these components can vary, such as horizontally or vertically, as is known in the field.

In some cases, the fluids moving through the subsea tree components as just described can be processed. Such processing can involve adding chemicals to the fluid flow, separating water and sand from hydrocarbons in the fluid flow, pumping the produced fluids, analyzing the produced fluids, in addition to other processes. The processing may be done in the subsea environment at the subsea wellhead and tree installation.

SUMMARY

In some embodiments, a subsea tree assembly includes a flow monitoring and measuring apparatus which may include a master valve block, a production wing branch extending from the master valve block, and a production wing valve block coupled to the production wing branch, the production wing valve block including a wing block connector. The assembly may include a fluid processing module including a frame, a module connector including an inlet and an outlet, and a fluid flow loop coupled between the inlet and the outlet of the module connector, wherein the module connector is fluidicly coupled to the wing block connector. The assembly may include a production isolation valve coupled to the wing block connector and a flow hub coupled to the production isolation valve, wherein the fluid flow loop of the fluid processing module includes a flow meter and a choke.

In some embodiments, the wing block connector and the module connector, when fluidicly coupled, connect the fluid flow loop to the production wing branch and to the production isolation valve via the production wing valve block. A production fluid in the production wing branch may follow a fluid flow path to the production wing valve block, into the fluid processing module flow loop, back to the production wing valve block, and to the production isolation valve and the flow hub. The module connector may be disconnectable from the wing block connector whereby the fluid processing module is retrievable. The production isolation valve may be disposed in a production isolation valve block separate from the production wing valve block. A fluid conduit outlet may be disposed in the production wing valve block to couple the wing block connector to the production isolation valve in the production isolation valve block. The fluidic coupling of the module connector and the wing block connector may be in a horizontal orientation, or in a vertical orientation. The flow hub may be coupled to a flowline.

In some embodiments, a flow monitoring and measuring apparatus for a subsea tree assembly may include a module frame, a module connector connectable to a production wing valve block, the module connector including an inlet and an outlet, a fluid flow conduit forming a loop from the outlet of the module connector back to the inlet of the module connector, and a flow meter coupled into the fluid flow loop. Also coupled into the fluid flow loop may be a choke, a chemical injection meter valve, and an acoustic sand monitor. When the module connector is connected to the production wing valve block, a production fluid flow from the production wing valve block may return to the production wing valve block via the module connector and the fluid flow loop.

In some embodiments, the flow monitoring and measuring apparatus may include an intrusive erosion monitor coupled into the fluid flow loop. The intrusive erosion monitor may be upstream of the choke. The flow monitoring and measuring apparatus may further include an aqua watcher coupled into the fluid flow loop. The flow monitoring and measuring apparatus may further include pressure and temperature transmitters coupled into the fluid flow loop. The apparatus may further include a blind T block coupled into the fluid flow loop upstream of the flow meter, a block elbow coupled into the fluid flow loop downstream of the flow meter and upstream of the choke, and a block elbow coupled into the fluid flow loop downstream of the flow meter and the choke. The blind T block may include an aqua watcher and the block elbow coupled into the fluid flow loop downstream of the flow meter and upstream of the choke may include an aqua watcher. The block elbow coupled into the fluid flow loop downstream of the flow meter and upstream of the choke may include the acoustic sand monitor and the chemical injection meter valve, and the block elbow coupled into the fluid flow loop downstream of the flow meter and the choke may include an intrusive erosion monitor.

BRIEF DESCRIPTION OF THE DRAWINGS

For a detailed description of exemplary embodiments, reference will now be made to the accompanying drawings in which.

DETAILED DESCRIPTION

Figure 1:
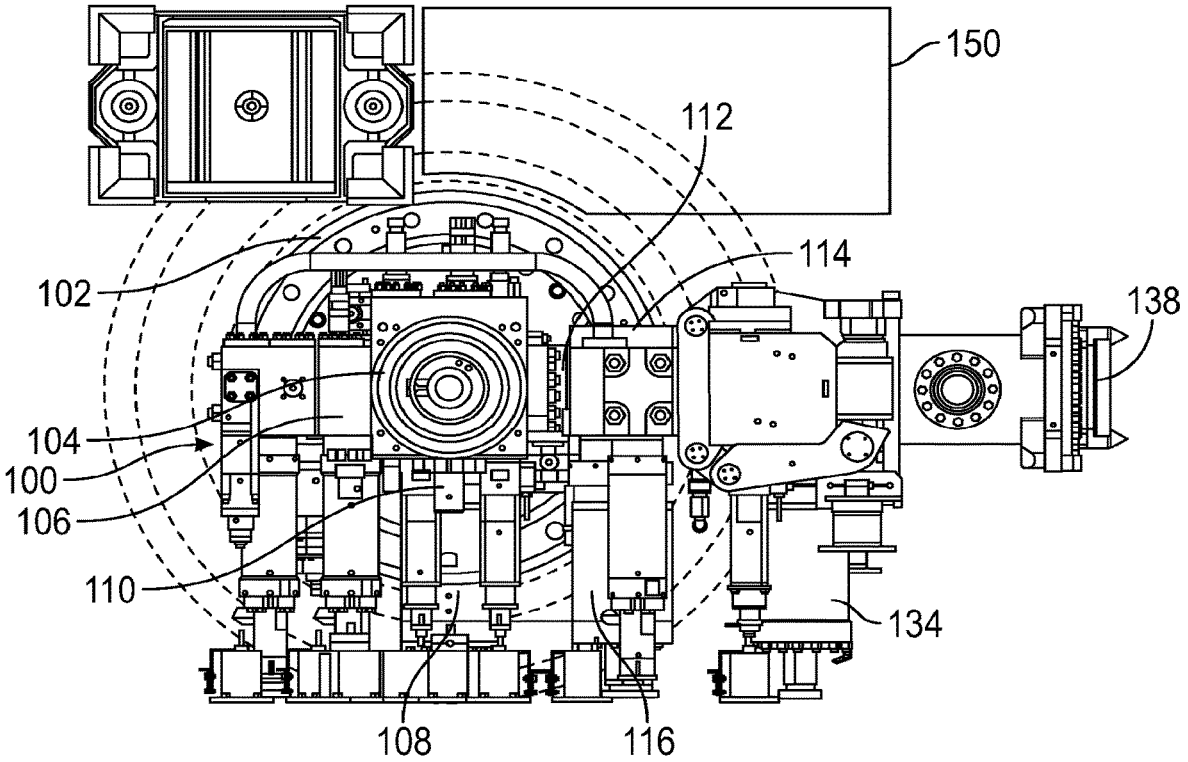
FIG. 1 is a plan view of an embodiment of a subsea tree assembly with an envelope for a position for a flow monitoring and measuring apparatus in accordance with principles disclosed herein.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. As used herein, the terms "up" and "down", "upper" and "lower", "upwardly" and downwardly", "upstream" and "downstream", "above" and "below", and other like terms indicating relative positions above or below a given point or element are used in this description to more clearly describe some embodiments. However, when applied to equipment and methods for use in environments that are deviated or horizontal, such terms may refer to a left to right, right to left, or other relationships as appropriate. The various characteristics mentioned above, as well as other features and characteristics described in more detail below, will be readily apparent to those skilled in the art upon reading the following detailed description of the embodiments, and by referring to the accompanying drawings.

Figure 2:
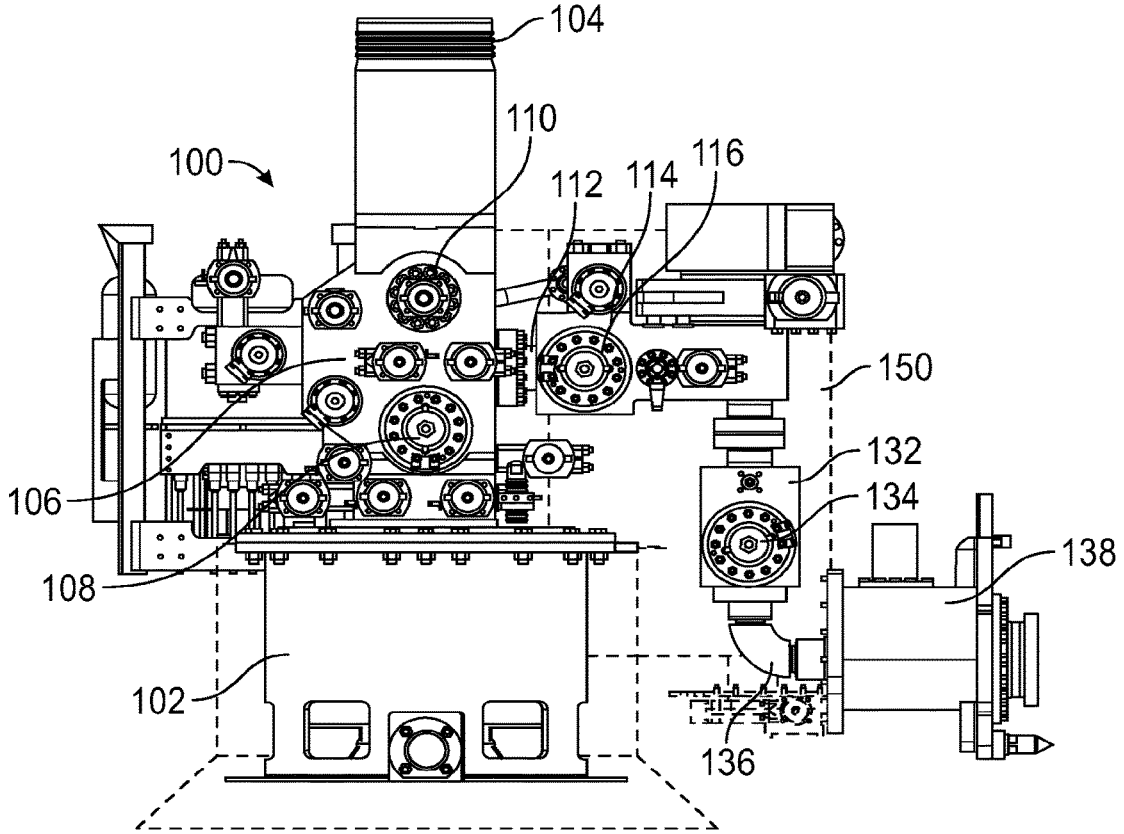
FIG. 2 is a side view of the subsea tree assembly of FIG. 1.
Figure 5:
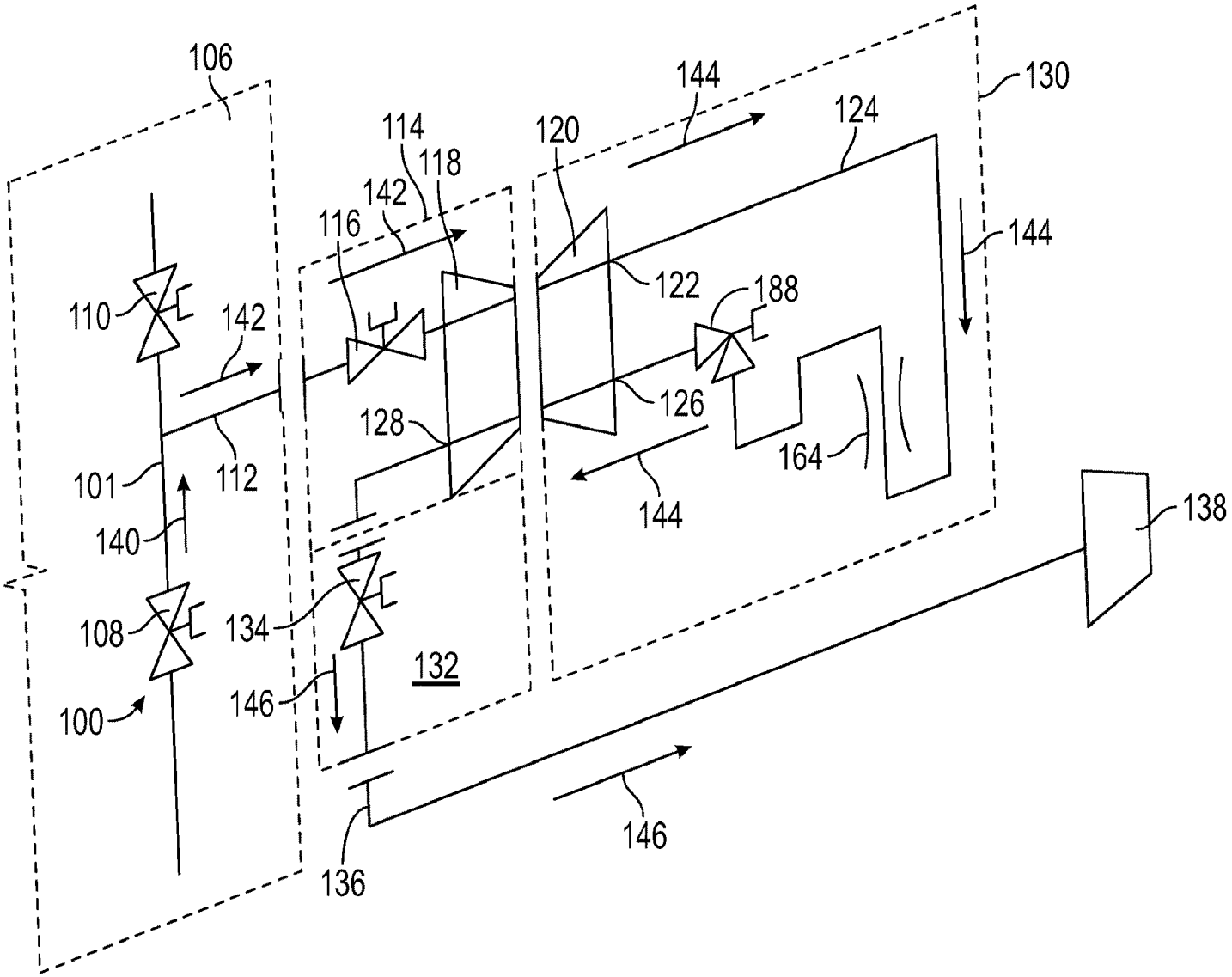
FIG. 5 is a schematic showing a connection between a production wing valve block of a production wing branch of the subsea tree assembly and the flow monitoring and measuring apparatus in accordance with principles disclosed herein.

Referring to FIGS. 1 and 2, an embodiment of a subsea tree assembly 100 with an envelope 150 for a position for a flow monitoring and measuring apparatus is shown in a plan view (FIG. 1) and a side view (FIG. 2). The subsea tree assembly may also be referred to as a subsea Christmas tree or a subsea tree, as well as other terms known in the field. The subsea tree is mounted atop a wellhead or other well stack equipment 102, and includes a conduit or hub 104 at an upper end. Central to the subsea tree is a master valve block 106 including a production master valve 108 and a production safety valve 110, all of which help regulate the flow of fluids in a production bore (not shown; a production bore 101 is shown in FIG. 5). A lateral or wing branch 112 extends from a side of the master valve block 106 and couples into a production wing valve block 114 having a production wing valve 116. The production wing valve block 114 couples to a production isolation valve block 132 having a production isolation valve 134. In some embodiments, the production isolation valve 134 is integral to the production wing valve block 114 rather than being part of a standalone production isolation valve block. A fluid flow conduit 136 couples the production isolation valve block 132 to a flow hub 138. In some embodiments, the flow hub 138 couples to a flowline for carrying production fluids to a subsea manifold, other subsea equipment or subsea wells, or to the sea surface as is known in the field.

Shown schematically at 150 is an envelope for the location for mounting and fluidicly coupling a flow monitoring and measuring apparatus to the subsea tree 100. The flow monitoring and measuring apparatus that is generally located at the envelope 150, which will be described more fully below, may also be referred to as a module or unit. More specifically, the apparatus may be referred to as a fluid processing module, a processing optimization module, or a retrievable processing module (if the module is disconnectable from the subsea tree 100 and retrievable to another location such as the sea surface).

Figure 3:
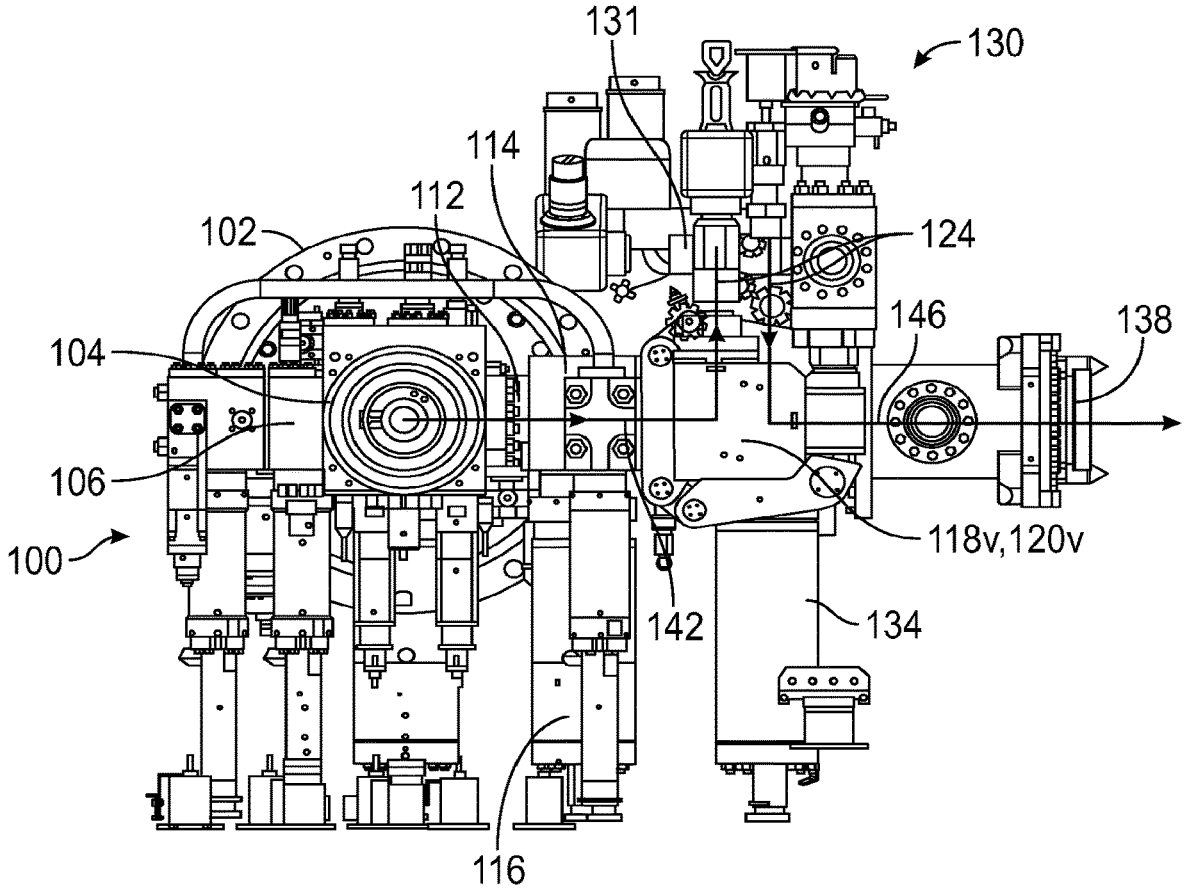
FIG. 3 is a plan view of the subsea tree assembly of FIG. 1 with an embodiment of a flow monitoring and measuring apparatus connected to the tree assembly in accordance with principles disclosed herein.
Figure 4:
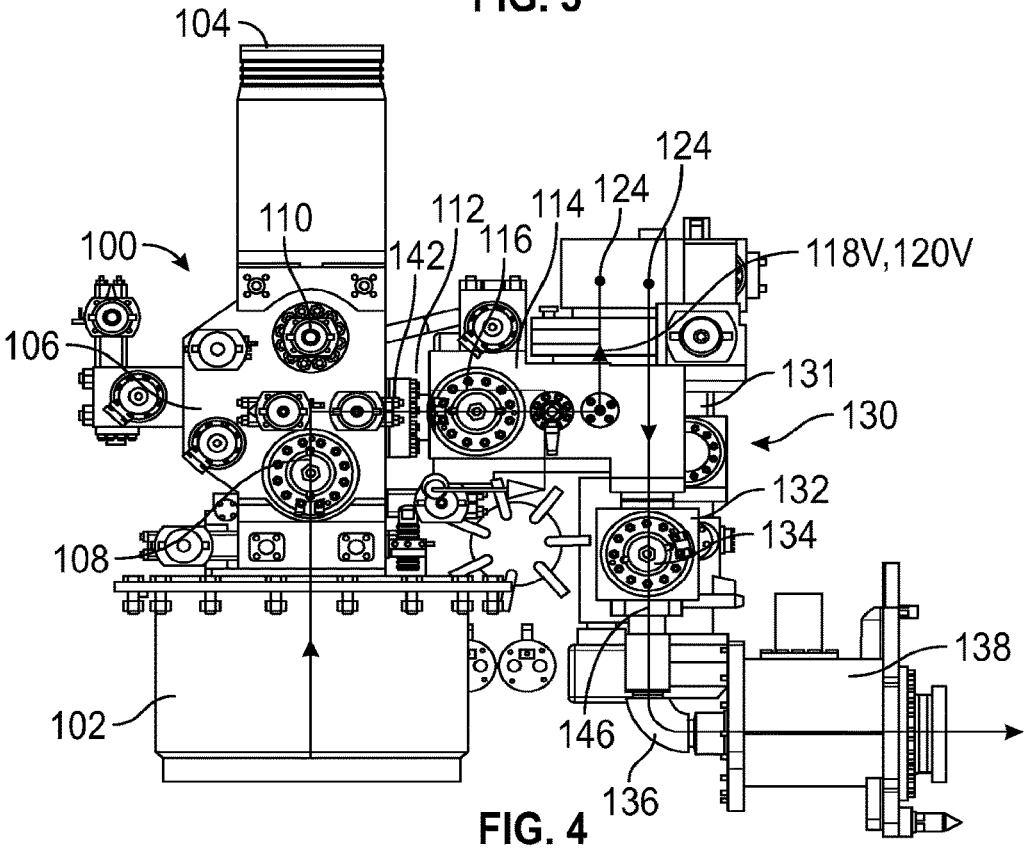
FIG. 4 is a side view of the and subsea tree assembly of FIG. 3.

Referring now to FIGS. 3 and 4, the subsea tree assembly 100 is again shown substantially similarly to the subsea tree assembly 100 of FIGS. 1 and 2. Components in FIGS. 3 and 4 are identified similarly with like components in FIGS. 1 and 2, and a detailed description of same is not given below. However, instead of the envelope 150 for a position for a flow monitoring and measuring apparatus, an embodiment of a flow monitoring and measuring apparatus 130 is shown. As noted above, the flow monitoring and measuring apparatus can also be referred to as a module or unit, and for ease of reference going forward, will be referred to as the fluid processing module 130. The fluid processing module 130 is generally understood to have a frame 131 for supporting the various components it contains, as will be described, including a flowpath out of and back into the production wing valve block 114.

The flow processing module 130 is coupled to, or in some embodiments, integral with, the production wing valve block 114. The fluidic coupling of the flow processing module 130 to the production wing valve block 114 allows a production fluid flow 142 in the lateral wing branch 112 to enter the production wing valve 116 and block 114 and then exit the wing block 114 to the flow processing module 130. The flow processing module 130 includes an internal fluid flowpath or conduit loop 124 that then returns the production fluid flow back to the wing block 114, thereby returning the production fluid flow back to its normal flow path 146 through the production isolation valve 134 and block 132, the conduit 136, and the flow hub 138. In this manner, the fluid processing module 130 is equipped to briefly bypass the production fluid flow both from the wing block 114 and back to that same wing block 114, via the internal fluid conduit loop of the fluid processing module 130. In some embodiments, the fluidic coupling of the flow processing module 130 to the production wing valve block 114 includes a vertical orientation of connectors or hub 118*v*, 120*v*. In other embodiments, the coupling orientation is horizontal as described more fully below.

Referring now to FIG. 5, the aforementioned connection or coupling between the fluid processing module 130 and the subsea tree 100 will be described in detail. FIG. 5 is a schematic view of a portion of the subsea tree 100 and a simplified version of the fluid processing module 130 to focus on the connection between the two. The subsea tree 100 includes a production fluid bore 101 having the production master valve 108 and the production safety valve 110, all directing a production fluid flow 140. The lateral or wing branch 112 directs the production fluid flow 142 to the production wing valve 116 of the wing block 114. The wing branch 112 then couples to a wing block connector 118 to deliver an inlet flow of the production fluid flow 142 to the wing block connector 118. The fluid processing module 130 includes a module connector 120 that is equipped to mate with and couple to the wing block connector 118, thereby delivering a production fluid flow from the wing block connector 118 and the production wing valve block 114 into the wing block connector 118 and the fluid processing module 130. In some embodiments, as shown in FIG. 5, the coupled wing block connector 118 and module connector 120 is in a horizontal orientation. The module connector 120 includes an outlet conduit 122 to deliver a production fluid flow 144 to the fluid flow loop conduit 124. Coupled into the flow loop conduit 124 are various fluid processing components and instruments as will be described more fully below, including, for example, a flow meter 164 and a regulating valve or choke 188.

The flow loop conduit 124 then couples to an inlet conduit 126 back into the module connector 120. As noted above, the module connector 120 mates and couples to the wing block connector 118 such that the production fluid flow 144 passes into and from the module connector 120 and back into the wing block connector 118. The wing block connector includes an outlet conduit 128 to deliver the production fluid flow 146 to the production isolation valve 134. In some embodiments, the isolation valve 134 is part of the production isolation valve block 132 as shown in FIG. 5, wherein the blocks 114, 132 are separated by a dotted line. In other embodiments, the isolation valve 134 is disposed in and integral to the production wing valve block 114. The isolation valve 134 couples to a fluid flow conduit 136 to then deliver the production fluid flow 146 to the flow hub 138. In some embodiments, the master valve block 106 may be referred to as a first valve block, and the production wing valve block 114 may be referred to as a second valve block, such that the flowpath through the fluid processing module 130 exits the second valve block and then re-enters the second valve block before the fluids are directed on as described above.

In some embodiments, the fluid processing module 130 is a retrievable processing module because the module connector 120 is connectable to and disconnectable from the wing block connector 118. After disconnecting the module connector 120 from the wing block connector 118, the module 130 can be retrieved from the subsea tree 100 to another location. In some embodiments, the fluid processing module 130 is integral to the subsea tree 100 via the production wing valve block 114. In any case, the flowpath or the fluid flow loop conduit 124 of the fluid processing module 130 connects out of and back into the production wing valve block 114. In some embodiments, by flowing out of and back into the production wing valve block 114 or the second block, the footprint and components needed to achieve such a flowpath can be reduced over other configurations. In some embodiments, the connection at the production wing valve block 114 or second block, which is on the subsea tree 100, can be standardized while the opposite, mating connection allows the flow path behind that connection to be configurable as needed.

Figure 6:
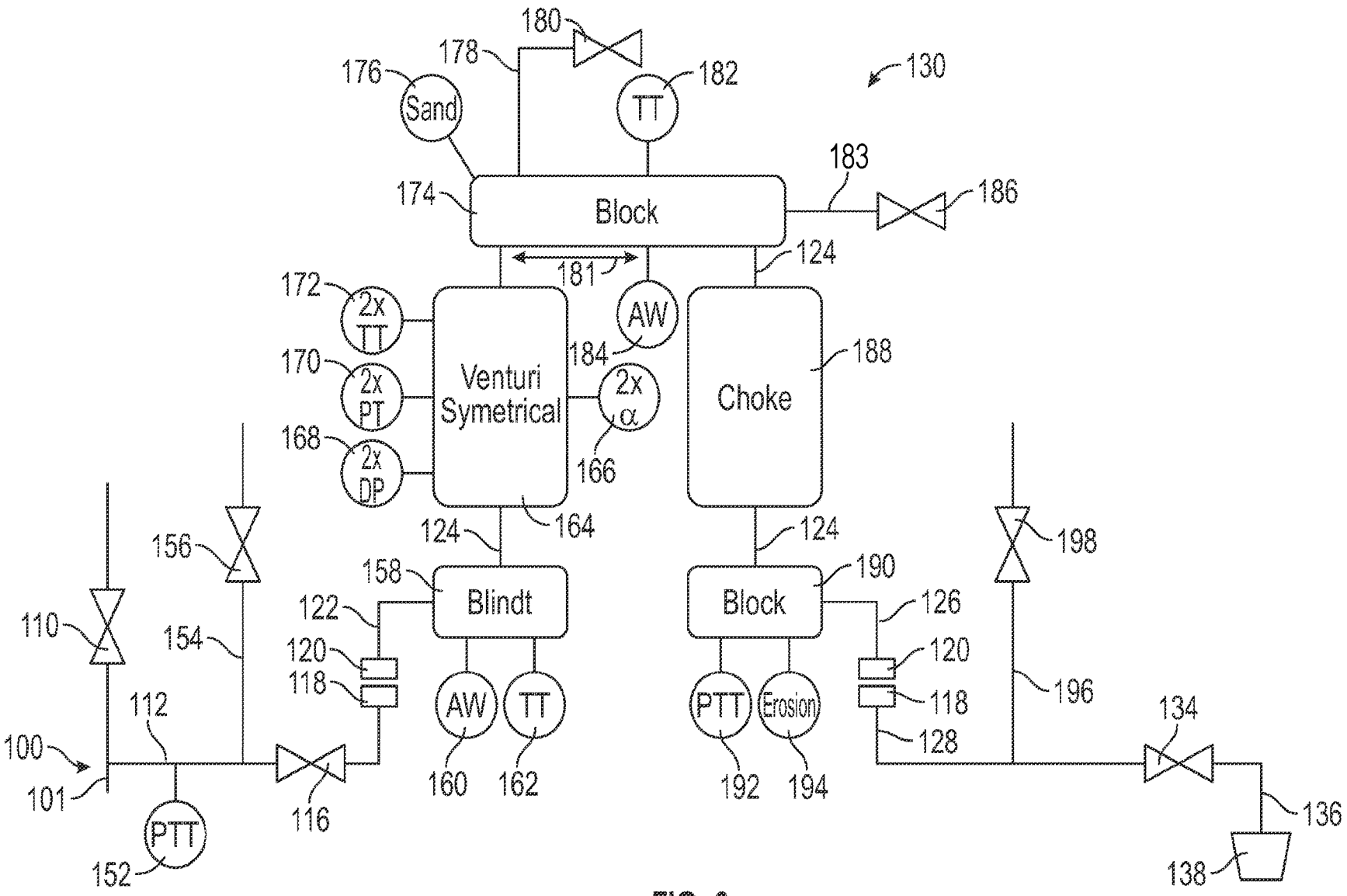
FIG. 6 is a schematic diagram of the internal piping and instrumentation of the flow monitoring and measuring apparatus in accordance with principles disclosed herein.

Referring next to FIG. 6, a schematic diagram illustrating the details of the internal piping and instrumentation of the fluid processing module 130 is shown. The subsea tree 100 delivers productions fluids from the production fluid bore 101 to the production wing branch 112. The production wing branch 112 may include a conduit 154 for a chemical injection meter valve (CIMV) 156 for various required processes for the subsea tree 100 as is known in the field. The production wing branch 112 couples to the production wing valve 116 and the wing block connector 118 of the production wing valve block 114 (not shown). The wing block connector 118 couples to the module connector 120 and the outlet conduit 122 that initiates the fluid flow loop conduit 124. Coupled into the flow loop conduit 124 is a Blind T block 158. In some embodiments, the Blind T block 158 is for agitating the fluid flow before the flow enters the flow meter 164, and may also be referred to as a first fluid conditioning feature. In some embodiments, the Blind T block 158 includes one or more water analysis meters, such as an aqua watcher 160 for water percentage analysis and a temperature transmitter 162. In various embodiments, the flow meter 164 may include gamma or nuclear sources 166, differential pressure sensors 168, pressure transmitters 170, and temperature transmitters 172. In some embodiments, the flow meter 164 is in a vertical orientation.

The fluid flow loop conduit 124 then couples to a multi-function block 174. In various embodiments, the block 174 may include a sand monitor 176, a temperature transmitter 182, an aqua watcher 184 for water analysis, and multiple conduits 178, 183 for chemical injection meter valves (CIMV) 180, 186 that may include chemical injection measurement equipment. In some embodiments, the sand monitor 176 is a non-intrusive acoustic sand monitor that may be located at an elbow of the block 174, as shown, to assist with acoustic sand monitoring by accelerating the fluid flow and making noise in the flow. Accordingly, the block 174 may also be referred to as a second fluid conditioning feature. In some embodiments, the CIMV 180 may be used for monoethylene glycol (MEG) injection to prevent or break down hydrates. A length 181 of the block 174 may be needed to mix the injected MEG, and the aqua watcher 184 can measure the percentages or ratio of water and MEG. In some embodiments, the CIMV 186 may be used to inject inhibitors, such as corrosion inhibitors or wax inhibitors. The CIMVs 180, 186 may be located as shown so as not to have a negative interaction with the fluid flow in the conduit 124, and so as not to interfere with readings from the sand monitor 176 and the aqua watcher 184, for example.

The fluid flow loop conduit 124 next couples to a regulating or control valve 188, which is also known as a choke, for regulating the pressure in the fluid flow loop conduit 124. Following the choke 188, a flow conditioning block 190 is coupled into the fluid flow loop conduit 124, and may also be referred to as a third fluid conditioning feature. In some embodiments, the block 190 includes a pressure and temperature transmitter 192 and an erosion monitor or probe 194, and can be configured as an elbow. In some embodiments, the erosion monitor 194 is an intrusive erosion monitoring sensor. The fluid flow loop conduit 124 then couples back into the module connector 120 via the inlet conduit 126 such that the fluid flow loop conduit 124 is ultimately coupled back into the wing block connector 118, thereby reducing the footprint and number of components needed to fluidicly couple the fluid processing module into the production flowpath of the subsea tree. Furthermore, in some embodiments, the connection at the module connector 120 and the wing block connector 118 can be standardized across various subsea trees while the fluid flow loop conduit 124 and the components and instruments coupled into it can be configurable as needed. The production flow path then proceeds as described before, through the conduit 128, the isolation valve 134, the conduit 136, and the flow hub 138. The conduit 136 may include a conduit 196 for a CIMV 198 for various required processes for the subsea tree 100 as is known in the field.

The fluid processing module 130 as just described includes various features for conditioning the fluid flow in the flow loop conduit 124 prior to the fluid being monitored and measured along the flowpath, thereby improving accuracy of the measurements. In some embodiments, the flow meter 164 is vertically oriented such that fluid flow is upward through the flow meter 164 for multiphase flow. The flow meter 164 may be located downstream of the conditioning feature of the Blind T block 158 and upstream of the flow control valve or choke 188. In some embodiments, one or more water analysis meters, such as aqua watchers 160, 184, may be located both upstream and downstream of the flow meter 164 and positioned or oriented in water enriched regions, such as the underside of certain components like the Blind T block 158 and the multi-function block 174. In some embodiments, the non-intrusive sand monitor 176, the intrusive erosion monitor 194, the pressure and temperature measurements 182, 192 are located downstream of certain features to maximize the accuracy of the measurements. For example, such instruments are located downstream of the flow meter 164. In some embodiments, certain of these instruments, such as the intrusive erosion monitor 194, are located either upstream or downstream of the choke 188. With maximized accuracy of measurements, the overall monitoring and processing of the fluids can be optimized to provide useable data that can be fed back into the larger production process, thereby increasing the efficiency by which fluids are produced from the well.

In some embodiments, the fluid in the flow loop conduit 124 is single phase flow, so the flow meter 164 may be located either upstream or downstream of the choke 188. In some embodiments, the flow meter 164 may be oriented horizontally or vertically.

In some embodiments, the fluid processing module 130 is a retrievable processing module that can be pre-installed on the subsea tree 100 or subsea deployed and retrieved. The retrievable processing module may include a capture, guidance, and alignment system such that it can be installed over an inlet oriented vertically, or translated horizontally using either mechanical or hydraulic devices for an inlet oriented horizontally.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. A flow monitoring and measuring apparatus for a subsea tree assembly, comprising:

a module frame;

a module connector connectable to a production wing valve block, the module connector including an inlet and an outlet;

a fluid flow conduit forming a loop from the outlet of the module connector back to the inlet of the module connector;

a flow meter coupled into the fluid flow loop;

a choke coupled into the fluid flow loop;

a blind T block coupled into the fluid flow loop upstream of the flow meter;

a first block elbow coupled into the fluid flow loop downstream of the flow meter and upstream of the choke;

a second block elbow coupled into the fluid flow loop downstream of the flow meter and the choke;

a chemical injection meter valve coupled into the fluid flow loop; and an acoustic sand monitor coupled into the fluid flow loop.

2. The flow monitoring and measuring apparatus of claim 1 wherein, when the module connector is connected to the production wing valve block, a production fluid flow from the production wing valve block returns to the production wing valve block via the module connector and the fluid flow loop.

3. The flow monitoring and measuring apparatus of claim 1 further comprising an intrusive erosion monitor coupled into the fluid flow loop.

4. The flow monitoring and measuring apparatus of claim 3 wherein the intrusive erosion monitor is upstream of the choke.

5. The flow monitoring and measuring apparatus of claim 1 further comprising an aqua watcher coupled into the fluid flow loop.

6. The flow monitoring and measuring apparatus of claim 1 further comprising pressure and temperature transmitters coupled into the fluid flow loop.

7. The flow monitoring and measuring apparatus of claim 1 wherein the blind T block comprises an aqua watcher, and the first block elbow comprises an aqua watcher.

8. The flow monitoring and measuring apparatus of claim 1 wherein the first block elbow comprises the acoustic sand monitor and the chemical injection meter valve, and the second block elbow comprises an intrusive erosion monitor.

* * * * *